US005359315A

United States Patent [19]

Inoue et al.

[11] Patent Number: 5,359,315

[45] Date of Patent: Oct. 25, 1994

[54] METHOD OF FORMING A THREE-LAYER STRUCTURAL SPIRAL INDUCTOR

[75] Inventors: Atsushi Inoue; Tatsuo Bizen; You Funada; Takashi Hiroshima, all of Nagaokakyo, Japan

[73] Assignee: Murata Manufacturing Co., Ltd., Nagaokakyo, Japan

[21] Appl. No.: 891,171

[22] Filed: May 29, 1992

[30] Foreign Application Priority Data

May 29, 1991 [JP] Japan ..... 3-126213

[51] Int. Cl.[5] ..... H01F 5/00

[52] U.S. Cl. ..... 336/200; 336/232; 336/188; 333/180; 333/168; 333/177

[58] Field of Search ..... 336/188, 200, 232; 333/168, 177, 180, 33, 161, 162, 246

[56] References Cited

U.S. PATENT DOCUMENTS 3,975,690 8/1976 Fleming ..... 333/246 X
4,117,438 9/1978 Kim et al. ..... 336/200 X
4,494,083 1/1985 Josefsson et al. ..... 333/33
5,057,798 10/1991 Moye et al. ..... 333/33

FOREIGN PATENT DOCUMENTS 55-24490 2/1980 Japan ..... 336/200

*Primary Examiner*—Leo P. Picard
*Assistant Examiner*—L. Thomas
*Attorney, Agent, or Firm*—Wenderoth, Lind & Ponack

[57] ABSTRACT

A selected inductance can be provided by a three-layer structural spiral inductor having an inductor conductive part disposed between two ground electrodes within an electric insulating substrate. This is carried out by eliminating a particular portion of one of those ground electrodes formed on the outer surface of the substrate until a desired inductance is obtained, beginning at a portion of such electrode corresponding to an exposed part of a through hole joint which is electrically connected to an inner peripheral end of a spiral inductor conductive part.

4 Claims, 1 Drawing Sheet

METHOD OF FORMING A THREE-LAYER STRUCTURAL SPIRAL INDUCTOR

BACKGROUND OF THE INVENTION

1. Field of the invention

This invention relates to a method of regulating an inductance (or obtaining a selected inductance) of a three-layer structural spiral inductor having a structure wherein a spiral conductive part is disposed between two ground electrodes through an insulating material.

2. Prior Art

In FIG. 2 and FIG. 3, a three-layer structural spiral inductor 1 to which this invention can be applied is shown. FIG. 2 is a bottom plan view, and FIG. 3 is a sectional view and is taken along the line III—III of FIG. 2.

The three-layer structural spiral inductor 1 has a substrate 2 comprising an electric insulating material, for example, a resin such as a glass-epoxy resin or ceramics. A plurality of wiring patterns 3, 4 and 5 are formed on one main surface of the substrate 2, and a first ground electrode 6 is formed on the other main surface of the substrate 2. A second ground electrode 7 is formed inside the substrate 2 so as to oppose the first ground electrode 6. Further, a spiral inductor conductive part 8 is formed inside the substrate 2 between the first ground electrode 6 and the second ground electrode 7.

A first through hole joint (or first through hole conductor) 10 is provided in the substrate 2 so as to electrically connect the outer peripheral end 9 of the inductor conductive part 8 and the first and second ground electrodes 6 and 7. On the other hand, a second through ho 1 e j o int ( or second through hole conductor) 12 is provided in the substrate 2 so as to electrically connect the inner peripheral end 11 of the inductor conductive part 8 and the specific wiring pattern 3. Gaps 13 and 14 are provided between the second through hole joint 12 and each of the first and second ground electrodes 6 and 7, respectively, so that the second through hole joint 12 is not electrically connected to either the first or the second ground electrode 6, 7.

The three-layer structural spiral inductor 1 as mentioned above is used for a voltage-controlled oscillator, for example, and parts which construct an oscillation circuit are packaged on the substrate 2.

Conventionally, the three-layer structural spiral inductor 1 mentioned above was (1) used without any regulation, and (2) in case this conductor 1 was used for a resonance system, a variable element such as a trimmer capacitor was connected to the outside and the resonance system was regulated thereby.

However, in the case of (1), since the inductor 1 was used without any regulation, there was a problem, that is, the inductance given by the inductor conductive part 8 and a dispersion of the surrounding parts could not be rectified.

On the other hand, in the case of (2), since other parts such as a variable element were required, the cost would rise and the area of the substrate 2 became enlarged because of the package of the above variable element.

SUMMARY OF THE INVENTION

The object of this invention is to provide a method of regulating a three-layer structural spiral inductor which can solve the above problems.

This invention is applied to a three-layer structural spiral inductor comprising an electrical insulating substrate, a wiring pattern formed on one main surface of the substrate, a first ground electrode formed on the other main surface of the substrate, a spiral inductor conductive part formed inside the substrate between the first ground electrode and the second ground electrode, a first through hole joint provided in the substrate so as to electrically connect the outer peripheral end of the inductor conductive part and the first and second ground electrodes, and a second through hole joint provided in the substrate so as to electrically connect the inner peripheral end of the inductor conductive part and the wiring pattern. In order to solve the above technical problems, this invention is characterized in that a portion of the first ground electrode, extending from an exposed part of the second through hole joint on the other main surface of the substrate, is eliminated.

Operation

In this invention, by eliminating the first ground electrode at a portion thereof beginning at an exposed part of the second through hole joint on the other main surface of a substrate, a magnetic flux can be allowed to leak outside, and thus an inductance given by the inductor conductive part can be effectively enlarged.

BRIEF DESCRIPTION OF THE DRAWINGS

The manner in which the foregoing and other objects of this invention are accomplished will be apparent from the accompanying specification and claims considered together with the drawings, wherein:

DETAILED DESCRIPTION OF THE INVENTION

Figure 1:
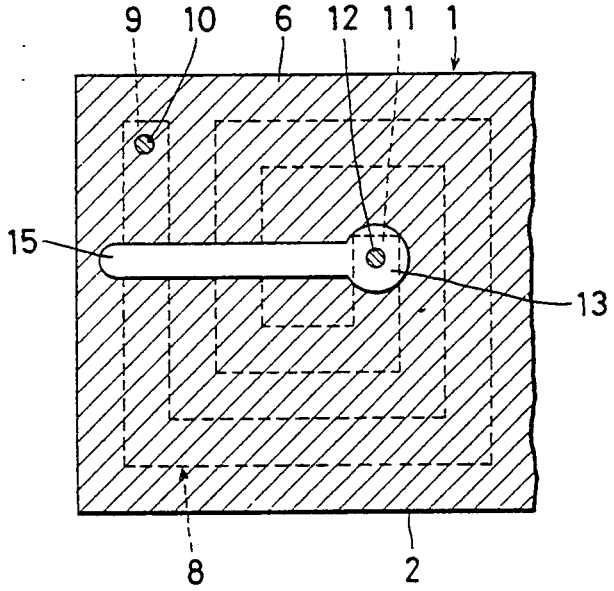
FIG. 1 is a bottom plan view of a three-layer structural spiral inductor showing an embodiment of an example of this invention.
Figure 2:
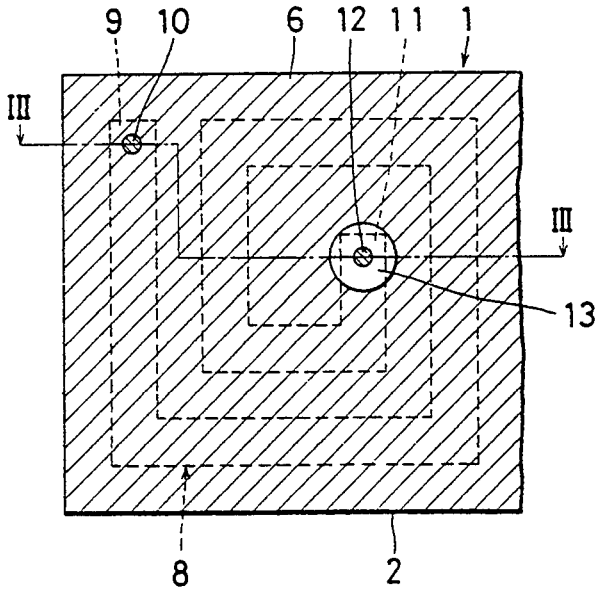
FIG. 2 is a bottom plan view of a three-layer structural spiral inductor 1 to which this invention can be applied.
Figure 3:
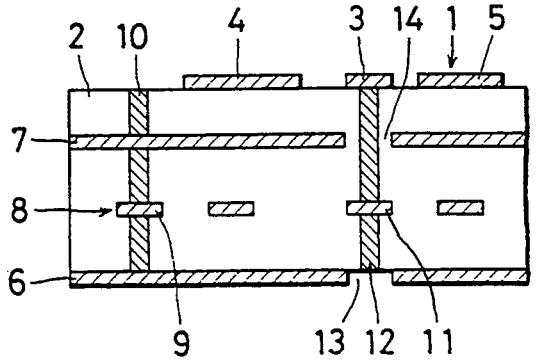
FIG. 3 is a sectional view taken along the lines III—III of FIG. 2.

FIG. 1 shows an embodiment of an example of this invention. FIG. 1 corresponds to the mentioned FIG. 2. Therefore, the same references are used for the elements corresponding to the elements shown in FIG. 2, and the overlapped explanations are omitted.

In FIG. 1 the eliminated part 15 is shown in the first electrode 6. The eliminated part 15 is formed by cutting off a portion of the first electrode 6 with a laser beam for example.

The eliminated part (or electrodeless area) 15 is formed by being cut off gradually starting at the exposed part of the second through hole joint 12 on the main surface of the substrate 2 on which the first ground electrode 6 is formed so that the inductance to be regulated can be a desired value. If such cutting off is carried out so that the eliminated part 15 is formed in the direction which crosses the inductor conductive part 8 as shown in FIG. 1, it is more effective. Once the eliminated part 15 is formed like this, a magnetic flux generated in the inductance conductive part 8 is leaked outside such that the inductance of the inductor conductive part 8 can be enlarged outwardly. Therefore, if the area of the eliminated part 15 is enlarged, the inductance can be more greatly regulated. For instance, the eliminated part 15 can be extended halfway across the region which opposes the inductor conductive part 8 of the first ground electrode 6, and it is possible to secure a large variable range therefor.

Since the inductance is enlarged by the formation of the eliminated part 15, needless to say, before the regulation, it is designed so that the inductance given by the inductor conductive part 8 may be smaller than the prescribed value.

Effect of the invention

Therefore, according to this invention, it is possible to regulate an inductance given by the inductor conductive part without adding any treatment directly to the inductor conductive part formed inside the substrate. As described above, not only can the elimination of the first ground electrode be easily carried out with, for example, a laser beam, but also a three-layer structural spiral inductor having a desired property can be obtained economically since a variable element or the like is not used.

Further, since it is not necessary to package a variable element for regulating on the substrate, the area of the substrate on which parts are packaged can be smaller, and as a result, it is possible to devise a method to miniaturize an apparatus having the three layer structural spiral inductor such as described above.

Although the invention has been described in its preferred form with a certain degree of particularity, it is understood that the details of construction and the combination and arrangement of parts may be changed without departing from the spirit and the scope of the invention as hereinafter claimed.

We claim:

1. A method of obtaining a selected inductance from a three-layer structural spiral inductor, comprising the steps of:

providing a three-layer structural spiral inductor comprising an electric insulating substrate, a wiring pattern formed on one main surface of said substrate, a first ground electrode formed on the other main surface of said substrate, a second ground electrode formed inside said substrate, a spiral inductor conductive part formed inside said substrate between said first ground electrode and said second ground electrode, a first through hole conductor provided in said substrate so as to electrically connect an outer peripheral end of said inductor conductive part and said first and second ground electrodes, and a second through hole conductor provided in said substrate so as to electrically connect an inner peripheral end of said inductor conductive part and said wiring pattern, an electrodeless void being formed in said first ground electrode adjacent on end of said second through hole conductor to expose said second through hole conductor through said first ground electrode; and removing a portion of said first ground electrode to form an electrodeless area connected to and extending away from said electrodeless void.

2. A method as recited in claim 1, wherein said step of removing comprises cutting away said portion of said first ground electrode with a laser beam.

3. A method as recited in claim 1, wherein said electrodeless area formed in said step of removing is superposed with a portion of said spiral inductor conductive part.

4. A method as recited in claim 1, wherein said electrodeless area formed in said step of removing is superposed across at least one turn of said spiral inductor conductive part.

* * * * *